US009687879B2

(12) United States Patent
Schneeberger

(10) Patent No.: US 9,687,879 B2
(45) Date of Patent: Jun. 27, 2017

(54) SCREEN LINING

(71) Applicant: Schenck Process GmbH, Darmstadt (DE)

(72) Inventor: Patrick Schneeberger, Mossautal (DE)

(73) Assignee: Schenck Process GmbH, Darmstadt (DE)

( * ) Notice: Subject to any disclaimer, the term of this patent is extended or adjusted under 35 U.S.C. 154(b) by 0 days.

(21) Appl. No.: 14/971,293

(22) Filed: Dec. 16, 2015

(65) Prior Publication Data

US 2016/0096199 A1 Apr. 7, 2016

Related U.S. Application Data

(63) Continuation of application No. PCT/EP2014/001329, filed on May 16, 2014.

(30) Foreign Application Priority Data

Jun. 17, 2013 (DE) ..... 10 2013 010 051

(51) Int. Cl.
*B07B 1/46* (2006.01)

(52) U.S. Cl.
CPC ..... *B07B 1/4645* (2013.01); *B07B 2201/02* (2013.01)

(58) Field of Classification Search
CPC B07B 1/46; B07B 1/4645; B07B 1/48; B07B 1/49; B07B 2201/02
USPC ..... 209/405, 409
See application file for complete search history.

(56) References Cited

U.S. PATENT DOCUMENTS

| | | | | |
|---|---|---|---|---|
| 3,905,897 A | | 9/1975 | Jacobson | |
| 4,383,919 A | | 5/1983 | Schmidt | |
| 4,670,136 A | * | 6/1987 | Schmidt | B07B 1/4645 209/399 |
| 4,871,288 A | * | 10/1989 | Schmidt | B07B 1/4645 209/399 |
| 5,213,217 A | | 5/1993 | Galton et al. | |
| 5,361,911 A | * | 11/1994 | Waites, Sr. | B07B 1/4645 209/399 |
| 5,398,817 A | * | 3/1995 | Connolly | B07B 1/46 209/399 |

(Continued)

FOREIGN PATENT DOCUMENTS

| | | |
|---|---|---|
| AU | 742060 B2 | 6/1999 |
| DE | 34 25 485 A1 | 1/1986 |

(Continued)

*Primary Examiner* — Joseph C Rodriguez
(74) *Attorney, Agent, or Firm* — Muncy, Geissler, Olds & Lowe, P.C.

(57) ABSTRACT

A screen lining having an adapter strip for fastening a screen mat or two screen mats arranged adjacent to each other to a supporting substructure in such a way that the screen mat or screen mats can be replaced. The adapter strip has projections on the side of the adapter strip facing away from the screen mats, which projections are integrally formed on the adapter strip in order to be inserted into openings on the substructure and have a bearing region on the side of the projections facing the screen mats, in which bearing region at least one hollow for the form-fitting fastening of the screen mats is arranged. The adapter strip has integrated deflecting blades, the top sides of which are angled downward with respect to a plane defined by the screen mats.

14 Claims, 2 Drawing Sheets

(56) References Cited

U.S. PATENT DOCUMENTS

| | | | | |
|---|---|---|---|---|
| 5,755,334 | A * | 5/1998 | Wojcik | F16B 5/0064 209/399 |
| 7,731,035 | B2 * | 6/2010 | Zubovich | B07B 1/4645 209/399 |
| 7,841,476 | B2 * | 11/2010 | Johnson | B07B 1/4645 209/392 |
| 8,544,655 | B2 * | 10/2013 | Trench | B07B 1/4645 209/405 |
| 9,375,757 | B2 * | 6/2016 | Wardell, Jr. | B07B 1/4645 |
| 2006/0175233 | A1 * | 8/2006 | Zubovich | B07B 1/4645 209/680 |
| 2009/0184032 | A1 * | 7/2009 | Zubovich | B07B 1/46 209/405 |

FOREIGN PATENT DOCUMENTS

| | | | |
|---|---|---|---|
| EP | 0 036 486 | A1 | 9/1981 |
| WO | WO 2006/110953 | A1 | 10/2006 |

* cited by examiner

SCREEN LINING

This nonprovisional application is a continuation of International Application No. PCT/EP2014/001329, which was filed on May 16, 2014, and which claims priority to German Patent Application No. 10 2013 010 051.8, which was filed in Germany on Jun. 17, 2013, and which are both herein incorporated by reference.

BACKGROUND OF THE INVENTION

Field of the Invention

The present invention relates to a screen lining.

Description of the Background Art

Screen linings are used for applications including vibrating screens and screening machines, which can be used for classifying various materials in the form of bulk products. So that the materials can be conveyed and separated by means of the screen linings, vibrating screens or screening machines are driven by force exciters. The screen linings customarily comprise screen mats or screening elements that include rectangular plastic sheets that have a plurality of openings as needed for classifying the bulk product. There are many different variations with regard to shape and size of the screen lining openings in this context. Depending on the stress on the screen linings, they are reinforced, if applicable, with an insert or a mesh made of metal. In addition, screen linings comprise adapter strips or snap-lock profiles that serve as a fastening element between screen mats or screening elements and the supporting substructure of the vibrating screen or screening machine.

Screen linings are subject to high wear. This results primarily from loading and abrasive wear caused by the material being screened. In the case of flip-flop screens, the flexible screen mats are additionally moved continuously and are subjected to tensile loading, so that high forces act on the adapter strips, most particularly in the support region. For this reason, it is necessary to ensure secure retention of the screen mats in the adapter strips. For replacement of the screen linings, care must additionally be taken that their attachment can be accomplished quickly and economically. Moreover, the substructure of the screen lining, and thus the structural frame of the vibrating screen or of the screening machine, should not be affected, either during screen operation or during replacement of the screen linings.

A screen lining with rigid screening elements and a profiled member as intermediate element between the screening element and substructure is known from DE 34 25 485 C2, to which member the screening elements, which have an appropriate thickness, are fastened in a snap-lock manner at a lower recessed region. The profiled member has a horizontal lip that covers the top of the substructure.

In addition, U.S. Pat. No. 5,213,217 discloses a screen lining with an adapter strip for replaceable attachment of rigid screening elements to a supporting substructure, wherein the adapter strip has, on its side facing away from the screening elements, projections that are provided for insertion into openings in the substructure. The screening elements rest on a bearing region of the adapter strip, and have a recess in which an annular collar of a securing pin seated on the adapter strip engages and secures the screening elements.

SUMMARY OF THE INVENTION

It is therefore an object of the present invention to improve a screen lining with screening elements and associated adapter strips, wherein the primary aim is to ensure cost-effective installation of the screen linings and long service life of the screening machine substructure.

In an exemplary embodiment, a screen lining is provided for a flip-flop screen having an adapter strip for replaceable attachment to a supporting substructure of one or two screen mats arranged side by side. To this end, the adapter strip has, on its side facing away from the screen mats, projections intended for insertion into openings in the substructure. A steel beam or a hollow steel profile, which is arranged in a frame of the screening machine as a cross member or cross piece, is customarily provided as the substructure for the adapter strips. The substructure accordingly has bores or openings in which the projections of the adapter strip engage and where they are secured by means of snap-lock or screwed connections. The adapter strips additionally have, on their side facing the screen mats, a bearing region in which is located at least one recess for interlocking attachment of the screen mats. Accordingly, the screen mats can also have, on their underside, projections that correspond to the recesses in the adapter strips. A snap-lock connection is customarily provided between the screening element and adapter strip, so that the screening elements can be secured to the adapter strips without additional fasteners. According to an exemplary embodiment of the present invention, the adapter strip can have integrated deflecting flaps, the top sides of which can be angled downward with respect to a plane defined by the screen mats. Owing to the design of the adapter strips, a wear protection of the substructure is therefore achieved, since the adapter strip conducts the material being screened downward, away from the substructure, by means of the deflecting flaps. After the material being screened has passed through the screen mats, the slanted shape of the deflecting flaps thus prevents it from coming into contact with the substructure and causing damage there. Furthermore, the slanted shape of the deflecting flaps reduces the bearing region for the screen mats to a minimum area so that the screening area can be optimally utilized. Moreover, an accumulation of screened material between the screen mat and adapter strip is avoided.

The shape of the adapter strip and of the deflecting flaps can also be made to correspond to the outer contours of the substructure. This means that the underside of the adapter strip can be matched to the substructure, and the deflecting flaps can be formed with a length such that they cover the substructure in a shielding manner.

When rectangular or square hollow profiles are used as the substructure, they can also be fitted into the frame of the screening machine such that they point up and down with one edge, and their lateral faces are angled at 45° with respect to the plane of the screen. Accordingly, in one embodiment of the invention the adapter strip can have a V-shape that is attached to the substructure with the opening downward. Advantageously, the undersides of the deflecting flaps of the adapter strip enclose an included angle of 60° to 90°.

Advantageously, the included angle of the deflecting flaps is provided such that the deflecting flaps are spread apart when the adapter strip is applied to the substructure, and subsequently bear against the substructure under tension or under friction.

Another embodiment makes provision that a free space is provided between the adapter strip and screen mats, outside the bearing region of the screen mats, as a space for the passage of the material being screened. This means that the bearing region for the screen mats is kept to a minimum, and only comprises a groove or similar recess. The screen openings of the screen mats can thus extend up to the bearing region, since the material being screened can be diverted in the region of the substructure as well.

The screen linings having an adapter strip and/or screen mats can be made of plastic. As a result of this design, a great variety of interlocking connections or a combination of interlocking and frictional connections is possible with regard to the attachment of the adapter strips to the substructure and the attachment of the screen mats to the adapter strip.

The projections located on the side of the adapter strips facing away from the screen mats can be provided as cylinders, slotted cylinders, or expanding anchors, for example. In the case of slotted cylinders or expanding anchors, the adapter strips are first placed on the substructure such that the projections engage in openings provided for this purpose in the substructure. Then screws are screwed from above into the cylinders or expanding anchors, deforming or spreading apart their jaws, thus securing the position of the adapter strip on the substructure.

An embodiment of the invention provides that the connection between the screen mat and adapter strip is a snap-lock connection. To this end, the recess on the adapter strip and/or a corresponding projection on the screen mats has a triangular shape with rounded corners. As a result of this shape, the screen mat easily slides by means of the inclined surfaces into the recess when pressed against the adapter strip, and in its final position is prevented by the top edges from moving in the reverse direction.

An embodiment of the invention provides that the adapter strip can be reinforced in the bearing region by a troughlike reinforcement or strengthening structure. Because of the greater stability, it prevents the screen mat from coming loose and popping out. Consequently, the high forces from the screen mat motion are accommodated, and the adapter strip is prevented from being pulled out in the region of the recess or the support region.

Advantageously, space is provided at the recess on the adapter strip for impurities or dirt particles captured from the material being screened. This means that the recess on the adapter strip is made large enough that the projections of the screen mat can be inserted into the recess despite possible contaminants, and the snap-in connection between the screen mat and adapter strip nevertheless takes effect.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
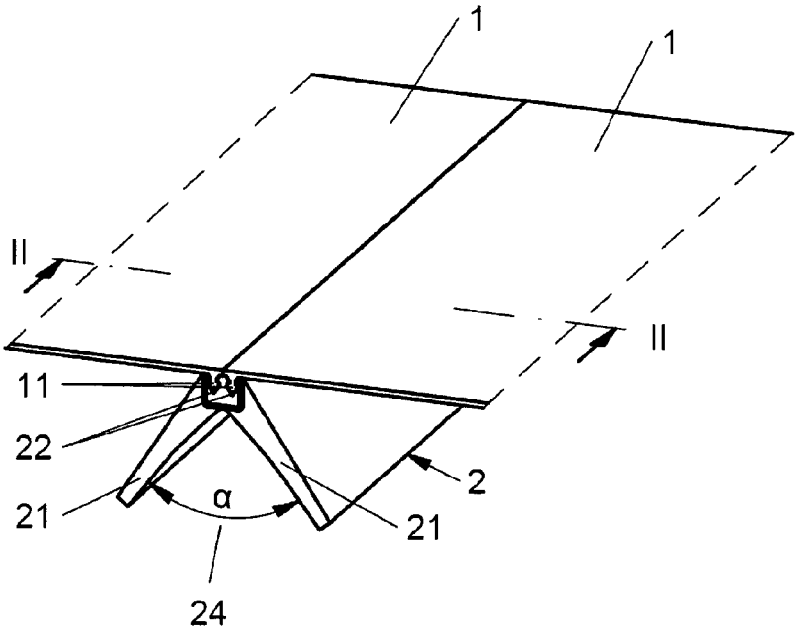
FIG. 1 is a perspective view of a detail of a screen lining according to the invention, having adapter strip and screen mats

FIG. 1 shows a screen lining according to the invention, which is intended for a flip-flop screen, in a perspective view. Screen mats 1 for flip-flop screens have high flexibility and consequently only very low strength. Since the moving substructure (not shown) likewise sets the screen mats 1 in motion, and the mats are subjected to a continuous extension and compression process, the secure attachment of the screen mats 1 to the substructure is critical for the service life of the screen lining. For the purpose of attaching the screen lining to the substructure or structural frame of the screening machine (not shown), an adapter strip 2 is provided, which has groove-like recesses 22 on its side facing the screen mats 1. Projections 11, which are formed on the underside of the screen mats 1, are inserted into these recesses 22.

Figure 2:
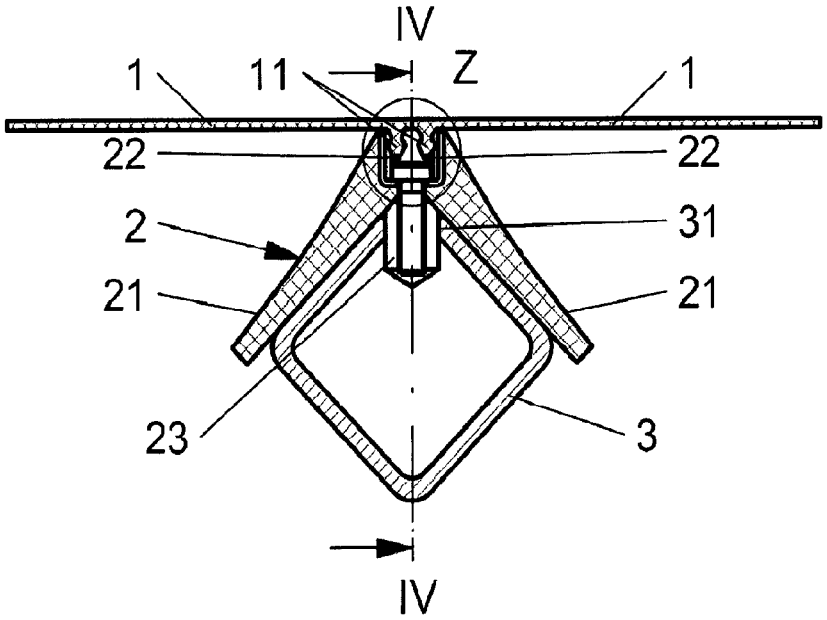
FIG. 2 is a cross-section along line II-II through the screen lining from FIG. 1
Figure 4:
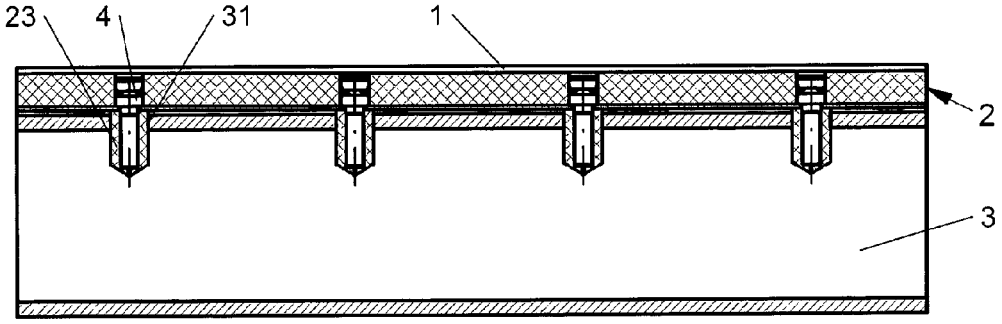
FIG. 4 is a cross-section along line IV-IV through the screen lining from FIG. 1

The adapter strip 2 is matched to the shape and arrangement of the substructure 3, and has two deflecting flaps 21, the underside of which conforms to the outside of the substructure 3, as shown in FIG. 2. Chosen as the substructure 3 is a hollow profile, which is attached to the frame of the screening machine (not shown) at an angle of 45° with respect to the horizontal. The included angle 24 of the deflecting flaps 21 is somewhat smaller here than the right angle of the hollow profile so that when the deflecting flaps 21 are applied to the substructure 3 they are spread apart and bear against the outside of the hollow profile under tension. It is evident from FIG. 4 that the adapter strip 2 has projections 23 at regular intervals on its side facing the substructure 3, and that the projections are inserted into openings 31 provided in the substructure 3 for this purpose. The projections 23 are provided with two slotted jaws in the nature of expanding anchors. Accordingly, the projections 23 have a through opening for a mounting screw 4, which is screwed from above into the projections 23 of the adapter strip 2 prior to installation of the screen mats 1, and the slotted jaws of the projections 23 are spread apart so that the adapter strip 2 is secured on the substructure 3.

Figure 3:
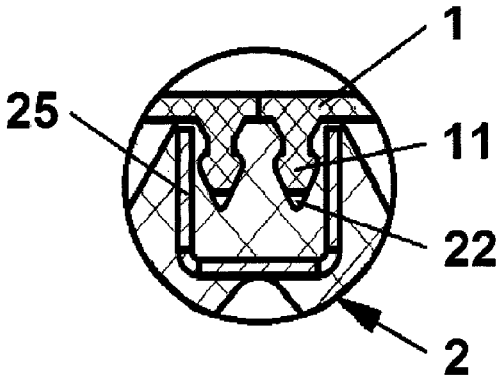
FIG. 3 is an enlarged view of the detail "Z" from FIG. 2

After attachment of the adapter strip 2, the screen mats 1 can be secured by driving or pressing the projections 11 into the recesses 22 of the adapter strip 2. FIG. 3 shows the connection between screen mats 1 and adapter strip 2 from FIG. 2 (detail Z) in an enlarged representation. The projections 11 of the screen mats 1 were given a special shape during manufacture or during the process of molding the screen mats 1. The projections 11 have a triangular or arrowhead shape with rounded corners. By means of the lateral inclined surfaces, the screen mats 1 can easily slide into the recesses 22 of the adapter strip 2, and lock into place in the recess 22 which is suitably designed with a negative shape. After locking into place, the screen mats 1 are secured in their final position by the protruding rear edges of their projections 11. A troughlike reinforcement 25 in the adapter strip 2 additionally ensures adequate stability in the bearing region. The troughlike reinforcement 25 surrounds the recesses 22 so that pull-out or deformation of the adapter strip 2 in the bearing region of the screen mats 1 is prevented.

In FIG. 2 it is illustrated that the adapter strip 2 completely covers the substructure 3 so that the screened material falling across the deflecting flaps 21 cannot come into contact with the substructure 3. Due to the arrangement of the hollow profile and the matching of the adapter strip 2 to its shape, it is possible to make the bearing region of the screen mats 1 on the adapter strip 2 just as narrow as possible. Since, moreover, the deflecting flaps 21 are angled downward, a free space is produced between the screen mat 1 and adapter strip 2 or substructure 3, and the material being screened can be carried away through this space. Accordingly, the screen openings in the screen mats 1 can be provided up to close proximity to the bearing region. This allows optimal utilization of the screening area.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A screen lining for a flip-flop screen comprising:

an adapter strip attached to a supporting substructure; and one or two screen mats replaceably attached side by side to the adapter strip, each screen mat having a projection on a side facing towards the adapter strip, wherein the adapter strip comprises:

projections formed on a side of the adapter strip facing away from the screen mats, the projections inserted into corresponding openings in the substructure;

a bearing region formed on a side of the adapter strip facing towards the screen mats, the bearing region having at least one recess for interlocking attachment of the screen mats, wherein the projections of the screen mats are inserted into the at least one recess of the bearing region of the adapter strip; and integrated deflecting flaps, wherein top sides of the integrated deflecting flaps are angled downward with respect to a plane defined by the screen mats, wherein a snap-lock connection is provided between the projections of the screen mats and the at least one recess of the adapter strip, so that the screen mats are secured to the adapter strip without additional fasteners.

2. The screen lining according to claim 1, wherein a shape of the adapter strip and of the deflecting flaps is made to substantially correspond to outer contours of the substructure.

3. The screen lining according to claim 1, wherein the adapter strip is provided with a V-shape.

4. The screen lining according to claim 1, wherein undersides of the deflecting flaps of the adapter strip enclose an included angle of 60° to 90°.

5. The screen lining according to claim 1, wherein the deflecting flaps bear against the substructure under tension due to spreading.

6. The screen lining according to claim 1, wherein a free space is provided between the adapter strip and screen mats, outside the bearing region, as a space for a passage of material being screened.

7. The screen lining according to claim 1, wherein the projections provided on the adapter strip are provided as slotted cylinders with spreadable jaws or as expanding anchors.

8. The screen lining according to claim 1, wherein the recess on the adapter strip and/or a corresponding projection on the screen mats has a triangular shape with rounded corners.

9. The screen lining according to claim 1, wherein the adapter strip and/or screen mats are made of plastic.

10. The screen lining according to claim 1, wherein the adapter strip is reinforced in the bearing region by a U-shaped reinforcement or strengthening structure.

11. The screen lining according to claim 1, wherein the recess on the adapter strip provides space for captured dirt particles.

12. The screen lining according to claim 1, wherein the entire top side and an entire bottom side of each deflecting flap is formed as a flat, planar surface from an integrated end of the deflecting flaps to distal ends thereof.

13. The screen lining according to claim 1, wherein each of the projections of the adapter strip has a through hole formed therethrough with a respective mounting screw extending through each through hole.

14. The screen lining according to claim 1, wherein the projection of each of the screen mats has a triangular shape with rounded corners.

* * * * *